United States Patent [19]

Lambert

[11] Patent Number: 4,465,203

[45] Date of Patent: Aug. 14, 1984

[54] CAN LID WITH PUSH IN TEAR TAB

[76] Inventor: Michael P. Lambert, 21 Richmond St., Portsmouth, N.H. 03801

[21] Appl. No.: 500,335

[22] Filed: Jun. 2, 1983

[51] Int. Cl.[3] ..... B65D 41/32

[52] U.S. Cl. ..... 220/268

[58] Field of Search ..... 220/268, 281, 254; 229/7 R

[56] References Cited

U.S. PATENT DOCUMENTS 4,078,693 3/1978 Asbury ..... 220/268

4,210,256 7/1980 Amberg et al. ..... 220/268

4,377,244 3/1983 Rossetti ..... 220/268

*Primary Examiner*—George T. Hall

*Attorney, Agent, or Firm*—Lee A. Strimbeck

[57] ABSTRACT

A stamped and scored one piece push-in tear tab can lid has a beak embossed in the tear tab along with a finger or thumb push area to the rear of the beak. When the push area is depressed the beak tears the tab loose and rotates with the tab into the can, buckling at a hinge line between the tab and push area. As the user's digit applies pressure behind the opening and not over it as in prior constructions, there is little opportunity for the user's finger or thumb going into the opening.

5 Claims, 4 Drawing Figures

CAN LID WITH PUSH IN TEAR TAB

This invention relates to can lids of the tear tab opening or "pop top" type and is particularly concerned with a one piece lid having a stamped and scored tear tab adapted to be bent into the container while remaining hinged to the lid such that it does not have to be separately disposed of after the container is opened.

PRIOR ART

A pre-examination search turned up the following references:

| | | |
|---|---|---|
| Asbury | 3,246,791 | April 1966 |
| Asbury | 3,355,058 | November 1967 |
| Klein | 3,779,417 | December 1973 |
| Perry | 3,843,011 | October 1974 |
| Perry | 3,952,912 | April 1976 |
| Perry | 4,062,471 | December 1977 |
| Asbury | 4,078,693 | March 1978 |
| Gynp, et al | 4,078,694 | March 1978 |
| Perry | 4,084,721 | April 1978 |
| Rossetti | 4,377,244 | March 1983 |

DISCUSSION

The most popular tear tab type of lid for beverage and similar containers is of a two piece construction having a finger operated pull ring riveted to the can lid which affects opening of the tear tab scored in the lid. The ring and tab separate from the lid and must be disposed of and this is usually done separately from the container. The torn out tab is a metallic curl with sharp edges and is often carelessly disposed of causing environmental and safety problems. The two piece lid is of a somewhat complicated manufacture which increases the expense of the lid. Frequently, the pull ring will separate from the rivet holding it to the lid without affecting opening of the tear tab. This is frustrating to the user.

There has been a desideratum for a one piece can lid that can be opened simply by pushing on the tab with the tab being bent into the can but remaining attached to the lid so that it does not have to be separately disposed of. The one piece constructions that have been proposed so far such as in U.S. Pat. No. 3,355,058 require the user's finger or thumb to apply a force on the tab over the opening to be created such that the finger or thumb tends to fall into the opening and be injured by being wedged into the opening and/or engaging the sharp edges of the tear line. More particularly, the force required to be applied by the user's digit is forward of the hinge for the tab; that is, on the same side as the opening. As the tab is bent into the can, the tab forms a sliding surface which leads the digit into the opening.

The present invention is addressed to this problem and proposes a solution wherein the force applied by the user digit is on the side of the hinge line opposite from that where the opening occurs which minimizes the possibility of the user's digit engaging the sharp edges of the hole. As the can lid proposed herein is of simple stamped one piece construction, it is considerably less complicated and expensive than the pull ring type of tear tab can lid.

THIS INVENTION

In brief compass, this invention is a one piece can lid with an embossed and scored push-in tear tab. The tear tab is scored around the end to tear upon the application of a downwardly force component in the area of that end. The score line extends around the tear tab rearwardly on either side to a hinge line. The tear tab has a centrally disposed embossed beak in it, the pointed end of which beak ends at the forward score line and the wider rearward portion of the beak is proximate the hinge line. On the other side of the hinge line is embossed a digit receiving area or hump which flows into and is a part of the embossment forming the beak. The tear tab is adapted to tear and rotate downwardly under a rotating pressure from the beak caused by a pushing pressure being applied by a user's digit to the digit receiving area with the embossment buckling proximate said hinge line so that the tab turns into the can on the hinge line out of the way of the outflowing of the contents.

The digit receiving area is preferably generally round with a concave center portion. The center portion is preferably lower than the rearward portion of the beak such that is an upwardly inclined ridged area between the two which prevents sliding of the force supplying digit towards the opening as the beak and tab rotate downwardly.

Also preferably, the can lid has two elongated rigidity imparting grooves in it, one on either side of the digit receiving area, the forward ends of which grooves commence at the hinge line at the ends of the score line. These grooves preferably taper rearwardly to the level of the can lid and extend to the other side of the digit-receiving area opposite the hinge line.

When the can lid is circular as is the case with beverage cans, the center line of the beak preferably extends radially from the center of the lid with the pointed end of the beak being close to the circumference of the can lid with the score line therebetween.

While the can lids of this type are usually made of aluminum, they can also be made of such other materials as tin plate and plastic.

DRAWINGS

DESCRIPTION

Figure 1:
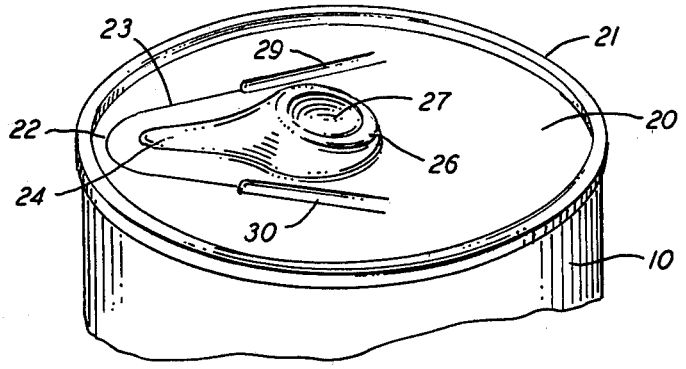
FIG. 1 is a perspective view of a beverage can lid having a tear tab according to this invention.
Figure 2:
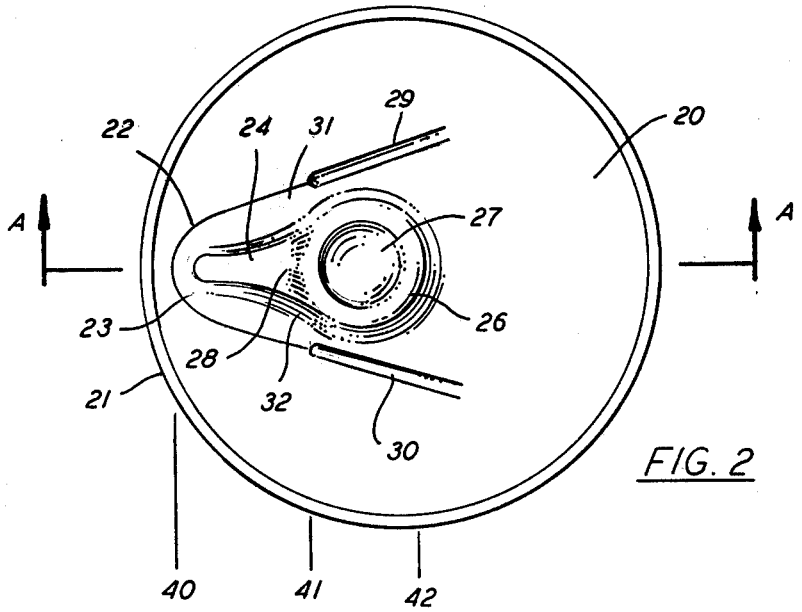
FIG. 2 is a top view of the lid.
Figure 3:
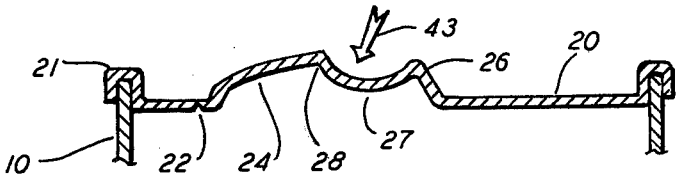
FIG. 3 is a sectional elevation view of the lid taken along line A—A of FIG. 2.

With reference to the drawings, a beverage can 10 has a lid 20 pressed thereon in a known manner with the use of a rolled edge 21. Can lid 20 has a roughly semicircular scored line 22 with the scoring being from the underside as shown in FIG. 3. Score line 22 terminates at a hypothetical hinge line indicated at 41. The tab on the opening side of the hinge line is indicated at 23. The center portion of tab 23 is embossed to have a beak 24. This beak has a narrower end which terminates proximate the center portion of score line 22 and a wider rearward or base portion that ends at hinge line 41.

There is a digit (finger or thumb) receiving area 26 on the opposite side of hinge line 41 which flows smoothly into and forms part of the embossment of beak 24. The center portion 27 of the digit receiving area 26 is preferably concave to assist seating of the finger or thumb.

Also as shown more clearly in FIG. 3, it is lower than the beak portion 24 such that there is an upwardly inclined surface and ridge 28 created which tends to prevent the digit from sliding toward or onto beak 24.

Two grooves 29 and 30 are preferably stamped into the lid as shown. These grooves impart rigidity to the lid on either side of the push area 26 and create some slack in the lid to facilitate the buckling action described infra. Preferably these grooves start at the hinge line 41 at the ends of the score line 22 and ensure that the tearing of the score line terminates at this point and that the bending of the tab 23 occurs at the desired hinge point 41 and does not go askew or fall further back towards the center of the can lid.

Figure 4:
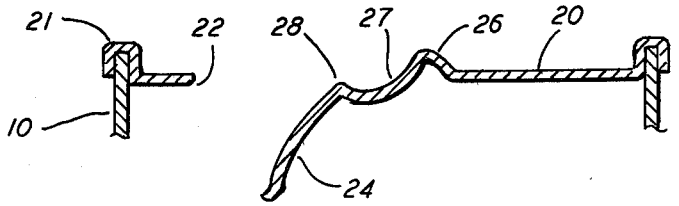
FIG. 4 is a view like FIG. 3 showing the lid in the open position.

A user to effect opening of the can applies pressure on area 27 usually by thumb, as indicated by force arrow 43. While the primary component of the pressure is downwardly, there is some forward component because of ridge 28 and cavity 27. With the depressing of push area 26 there is a rotating force applied to beak 24 because of the buckling of the side walls of the beak at approximately points 31 and 32 causing the narrow end thereof to exert downward pressure on score line 22. This causes score line 22 to part and tear back to hinge line 41 with the tear line being arrested by grooves 29 and 30. Beak 24 rotates with tab 23 into the interior of the can as shown in FIG. 4.

In summary, the invention is an improved one piece tear tab can lid characterised by having a beak or pressure bar embossed in the tear tab along with a raised finger push area contiguous to the rear end of the beak which, when depressed, causes the forward end of the beak to rotate downwardly breaking the tab from the lid and carrying it into the can. The beak buckles or permanently folds at its rearmost end to effect the pivoting action. The digital pressure applied by the user is behind not over the beak and the user's finger or thumb is prevented from sliding forward onto the beak by a ridge at the rear end of the beak.

I claim:

1. A one piece can lid with an embossed and scored push-in tear tab therein, a. one end of said tear tab being scored around that end to tear upon the application of downward pressure thereon, the score line extending around said tear tab rearwardly on either side thereof to a hinge line;

b. a centrally disposed upwardly embossed beak in said tear tab, the pointed end of which ends at said score line defining said one end and the wider rearward portion of said beak extending to said hinge line, and c. an embossed digit receiving area in said lid and on the other side of and contiguous said hinge line and flowing into and being a part of the embossment forming said beak, said tear tab being adapted to tear and rotate downwardly under a rotating pressure from said beak via a pushing pressure being applied by a digit to said digit receiving area, with said embossment buckling proximate said hinge line.

2. The can lid of claim 1 wherein said digit receiving area is lower than the said rearward portion of said beak such that there is an upwardly inclined ridge between the two tending to prevent sliding of a digit applying pressure to the embossment towards said beak.

3. The can lid of claim 1 wherein there are two elongated rigidity-imparting grooves stamped in said can lid, one on either side of said digit receiving area, the forward ends of which commence proximate said hinge line at the ends of said score line.

4. The can lid of claim 3 wherein said digit receiving area is approximately hemispherical with a concave central portion at the top and said grooves diverge on either side thereof from said hinge line and taper to the level of the can lid.

5. The can lid of claim 1 wherein said can lid is circular and the center line of said beak extends radially from the center thereof with said pointed end of the beak being proximate the circumference of said can lid.

* * * * *

UNITED STATES PATENT AND TRADEMARK OFFICE

Certificate

Patent No. 4,465,203 Patented August 14, 1984

Michael P. Lambert

Application having been made by Michael P. Lambert, the inventor named in the patent above identified, for the issuance of a certificate under the provisions of Title 35, Section 256, of the United States Code, adding the name of G. Steven Lambert as a joint inventor, and a showing and proof of facts satisfying the requirements of the said section having been submitted, it is this 2nd day of Apr., 1985, certified that the name of the said G. Steven Lambert is hereby added to the said patent as a joint inventor with the said Michael P. Lambert.

Fred W. Sherling,
*Associate Solicitor.*